US009221593B2

(12) United States Patent
Kay

(10) Patent No.: US 9,221,593 B2
(45) Date of Patent: Dec. 29, 2015

(54) STASHABLE STORAGE TUBE

(76) Inventor: Jeremy R. Kay, Berkley, MI (US)

( * ) Notice: Subject to any disclaimer, the term of this patent is extended or adjusted under 35 U.S.C. 154(b) by 1164 days.

(21) Appl. No.: 12/766,846

(22) Filed: Apr. 23, 2010

(65) Prior Publication Data

US 2010/0270200 A1 Oct. 28, 2010

Related U.S. Application Data

(60) Provisional application No. 61/172,153, filed on Apr. 23, 2009.

(51) Int. Cl.

| | |
|---|---|
| ***B65D 73/00*** | (2006.01) |
| ***B65D 81/02*** | (2006.01) |
| ***B65D 25/36*** | (2006.01) |
| ***B65D 41/16*** | (2006.01) |

(52) U.S. Cl.

CPC ..... *B65D 81/02* (2013.01); *B65D 25/36* (2013.01); *B65D 41/16* (2013.01); *B65D 2313/02* (2013.01)

(58) Field of Classification Search

CPC ..... B65D 73/00
USPC ..... 206/521
See application file for complete search history.

(56) References Cited

U.S. PATENT DOCUMENTS

| | | | | |
|---|---|---|---|---|
| 3,321,068 | A | 5/1967 | Beach | |
| 4,342,492 | A | 8/1982 | Spevak | |
| 4,452,362 | A | 6/1984 | Mancin | |
| 4,951,826 | A | 8/1990 | Tompkins | |
| 5,040,687 | A | 8/1991 | Whittington | |
| 5,159,138 | A | 10/1992 | Kleinhans | |
| 5,242,063 | A | 9/1993 | Ericksen et al. | |
| D344,654 | S | 3/1994 | McCrudden | |
| 5,311,698 | A | 5/1994 | Plost | |
| 5,503,316 | A | 4/1996 | Stewart | |
| 5,664,673 | A | 9/1997 | Perry | |
| 5,671,849 | A | 9/1997 | Bacon | |
| 5,720,547 | A | 2/1998 | Baird | |
| 5,934,464 | A * | 8/1999 | Vargo et al. | 206/315.11 |
| 6,390,296 | B1 * | 5/2002 | Griffith et al. | 206/320 |
| 6,607,085 | B2 | 8/2003 | Pavlic | |
| 6,843,399 | B2 | 1/2005 | Garcia | |
| D501,885 | S * | 2/2005 | Colson | D19/85 |
| 6,971,513 | B2 * | 12/2005 | Weinstein et al. | 206/321 |
| 2007/0090122 | A1 * | 4/2007 | Zeypang | 220/805 |

* cited by examiner

*Primary Examiner* — Anthony Stashick
*Assistant Examiner* — Raven Collins

(57) ABSTRACT

This device specializes in the protection of items of value and seeks to reduce any loss in value. The device is designed to protect its contents from damage, abuse, theft, misplacement, and unwanted access. It performs these duties through a number of ways. The device creates a sealed environment within, such that the contents are contained and separated from harm. Through the selection of the components making up its construction, the device provides a protective shelter for the items. Should the user of the device seek additional security for their items contained within, the device and included instruction provide for concealablity. Making use of the device in a concealed manner protects the items within by further removing them from harm's way; essentially removing the items of value from the interest of those seeking unauthorized access. Quite simply, an item that cannot be found, cannot be taken.

4 Claims, 7 Drawing Sheets

STASHABLE STORAGE TUBE

CROSS-REFERENCE TO RELATED APPLICATIONS

This application claims the benefit of U.S. Provisional Application No. 61/172,153 filed Apr. 23, 2009

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND

The device disclosed herein relates to the field of protective storage containers, more specifically to those that are portable. The protection sought to provide is of two distinct types. The first is that of a vessel used to contain items of interest, likely those of value; such that there is a barrier between the items and external sources that may cause damage or abuse to the items. This is similar in respect to the protection offered by egg cartons, suit cases, and safes. The second type of protection afforded by the device is that of concealability. This is similar to the manner in which camouflage is able to disavow the location of objects on which it is acting.

The primary means through which the device offers concealability is through the use of a material that is of a selectively attachable nature combined with the use of a carefully chosen location as suggested by the provided instruction. At present, the preferred selectively attachable material is a loop type fastener, commonly known as Velcro. The concept of using Velcro to selectively attach items is familiar and its utility has added benefit to numerous designs, likely dating back to the invention of Velcro itself.

There are other devices depicting the use of Velcro as a means for attachment to various surfaces, with some depicting means for selectively or adjustably attaching Velcro temporarily to various types of containers. However, there are few dedicated containers with durability and longevity being of consideration. There is also a lack of devices featuring the ability for completely blind placement and concealment in hidden or confined locations. The Velcro attachment in the current device may appear similar, but when the qualities of the current device are examined as a whole, the common uses diminish and the benefits of the present device become apparent.

Along with demand for the originally conceived embodiment described below, after making the device available to the public, further need was demonstrated unbeknownst to the inventor. Apparently the audio industry had been lacking a suitable device for the storage of shotgun microphones with their respective windscreens attached. A special order for the device described herein, according to requested dimensions of a significantly larger nature, was placed and fulfilled for the use in the storage and protection of these expensive and extremely sensitive microphones; where previously the industry was forced to rely on large and bulky cases.

BRIEF SUMMARY

The combined protection provides for a device that is able offer the benefits of both types along with benefits previously unrecognized. This provides for a larger number of potential applications, especially in areas where there were previously no solutions. Ultimately this offers the public a larger number of choices and the ability to choose a device more specifically suited to their needs. This protective ability allows the current device to succeed in the field of protective containers where others have not.

By safely concealing the device, the contents are protected from damage, theft, misplacement, and prying eyes. The concealed use provides superior security when compared to conventional methods, such as locks and alarms. By keeping the contents out of the view of a potential thief, the thief will be less likely to be aware of the item, and therefore will not only be less likely to make the initial breach into the home or vehicle, but the protected item will likely go unnoticed. The device further secures sensitive and valuable items by relocating them from conventional storage locations, such as the glove box, console, or dresser drawer; to a safer, hidden location. A burglar or thief is unlikely to expend the extra time searching beyond the obvious locations. Quite simply, an item that cannot be found, cannot be taken.

This device was designed with the intentions of protecting items of value. Similar devices employing Velcro generally focus on the utility of being able to attach various different items to a complex base unit; their teachings provide means for systems used to make items more readily accessible to the user. The current device can also be used to serve this purpose. However, it is not its sole intent as it is with the other devices. The completely different use and intentions invariably lead to a different construction and design.

Beyond the difference in structural features and in addition to the manner in which it is used; this device varies from those resembling it such that it can be used quickly and blindly to selectively attach itself to concealed locations out of the line of sight. The device, by means of two points of access, also provides for a fully accessible interior that can be selectively sealed and secured; thereby protecting the contents from various forms of damage and loss. The sum of these functions being embodied in a device that is simple, convenient, and pleasing to the touch.

This device is designed to be protective in all manners of the word. Focusing on the safety and protection of items of value and retaining said value against various forms of destruction and loss; results in a container that protects its contents from impact and crushing, as well as creating a product that is air and water tight in order to preserve the integrity and freshness of the contents.

If the consumer is ever to realize the benefits of its functionality, a product must be desirable to use and convenient to the consumer first. The current device is represents a product that is actually desirable to carry and soft on one's hands, while being pleasing to the touch and interesting to the eyes. The design of this device is focused on a smooth, solid, symmetrical feeling and appearance, with materials crafted in such a way that they also serve the above mentioned purposes of being resistant to impact and crushing, as well as air tight and water resistant. The smaller model is a compact size that fits quite comfortably in one's palm.

Through careful selection of materials and the simplified nature of this design, the cost efficient manufacture of this product is made available to anyone skilled in the trade. Though adaptable to mass production, the current model is designed specifically to be able to be completely manufactured from one's home with raw materials generally available. Similar containers require injection molding and complex assembly, resulting in higher initial investment and increased cost during ongoing manufacture. As a result, this requires one to obtain an outside manufacturer or costly manufacturing equipment. The simplified design of the current device, with no complicated base units or closures, allows for significantly cheaper manufacture; while also providing for simplified usage by the end user. This serves the objective of bringing the product to the market at a price that is fair and affordable to the everyday consumer.

Furthermore, the described device can be blindly attached to its mounting point, where as those that attach similarly, due to the nature of their construction, have a lesser chance of successfully attaching to any one location. The inability to blindly attach requires the user to identify and rotate the container to the proper direction prior to attachment to the base unit. As the current device is commonly used in areas where sight is restricted, the ability to blindly attach the device with unhindered success is highly desirable.

In other devices employing the use of Velcro as a selectively attachable medium, it can clearly be seen by looking at the surface to which the Velcro is attached, that the area comprising that of the Velcro measures only a small portion of total surface area of the container. While this may suit the intentions of using their device on a sunny afternoon out fishing, it provides little use in conquering the above mentioned problems of blind placement, which are solved by the current device.

The present invention involves loop Velcro being permanently affixed 360 degrees around a section of tube that is open at both ends. However subtle, these details are far from arbitrary and were carefully chosen to serve specific purpose in carrying out the intentions of the device. When concerning items of value and preserving said value it is desirable to make things in a solid and permanent manner. The current device has no sleeve to stretch with time or wear from use, possibly resulting in the container and its contents being inadvertently lost or separated from the mounting base. Nearly everyone has seen a pair of socks stretch with time.

The current device serves to create a sealed environment within; preventing the access of air, moisture, and water; preventing them from both entering and leaving the container. The use of end caps as described, results in no lids or lockable covers to break; breakage of which would possibly render containers of that manner useless. Additionally, the choice to use loop versus hook type Velcro on the outer surface of the present device provides far superior comfort to the hand when compared to those that attach similarly using hook type Velcro as a contact point. Furthermore, when using the device for bills or other objects of tight fit, both caps may be removed and the contents may be pushed out the opposite end through the use of a finger; this is a function not afforded to containers with only one opening.

The mounting point base unit of the present device is affixed in a permanent manner by means of self-adhesive hook type Velcro strip; this provides an inexpensive attachment that is easily cut to size with scissors. Similar systems of selectively attaching devices direct functionality towards base units that are of a temporary and selectively attachable nature. This is not a concern with the present device as the instructions provided instruct the user that the corresponding material of a selectively attachable nature that composes the base unit will likely be in an unobservable location, and therefore will need not be removed as it will go unnoticed should they discontinue use of the device.

That which is being described has not to do with the advantageous benefits of the utility of Velcro alone, but with the resulting outcome of the combination of the sum of materials comprising the device and the unobvious instruction provided. The result of this system allows the current device to succeed in the field of protective devices where others have failed or have provided a lesser form of protection.

Some of the drawings are shown depicting a hand 6 or other common items to aid in the understanding of the function relating to the chosen design parameters, it should be noted that the device may be constructed of various sizes and sorts so long as containing the various features outlined in the claims below.

DETAILED DESCRIPTION

The device at hand is of very simple design, yet none the less valuable. It embodies a design that is suitable for many uses, while composed of few actual components; yet once compiled, its distinction is clear and its function unsurpassed. Through careful selection, transformation, and combination of raw materials, and the provocation of a little ingenuity with carefully crafted instructions, the current device is able to offer more than any like it.

The raw materials are available from various manufactures specializing in materials of the respective art of the individual component. The device essentially begins as bulk length of material to be cut to size; generally being in the shape of an extruded closed walled shape with the length of the center being hollow. Able to be formed from any number of shapes, this is generally referred to as a tube. Currently the standard model calls for cylindrical polycarbonate tubing 1. The use of a material with a high strength to weight ratio, such as polycarbonate, allows the wall thickness to be kept to a minimum, thereby maximizing the interior volumetric capacity while maintaining the smallest outer dimensions.

The ratio of the outer to inner diameter is minimized with the intentions of maximizing the volumetric storage capacity while maintaining a sufficiently strong structure able to sustain its form while being subjected to damage and abuse. This damage and abuse could arise from any number of sources and can generally be construed as crushing, impact, penetration, contamination, and moisture. Its intent is to provide protection from sources causing a degradation or loss in value of the contents within. The selection of a material with the characteristics of a high strength to weight ratio is paramount to achieving the best results. Emphasis is placed on strength, durability, and the quality of appropriate materials. Due to this careful selection, it can fully support the weight of a full grown man without disturbing the contents; therefore demonstrating obvious superiority over other devices of this nature in the department of crush resistance. This strength to weight ratio is a key design consideration when selecting materials for use in the construction of the device.

Figure 6:
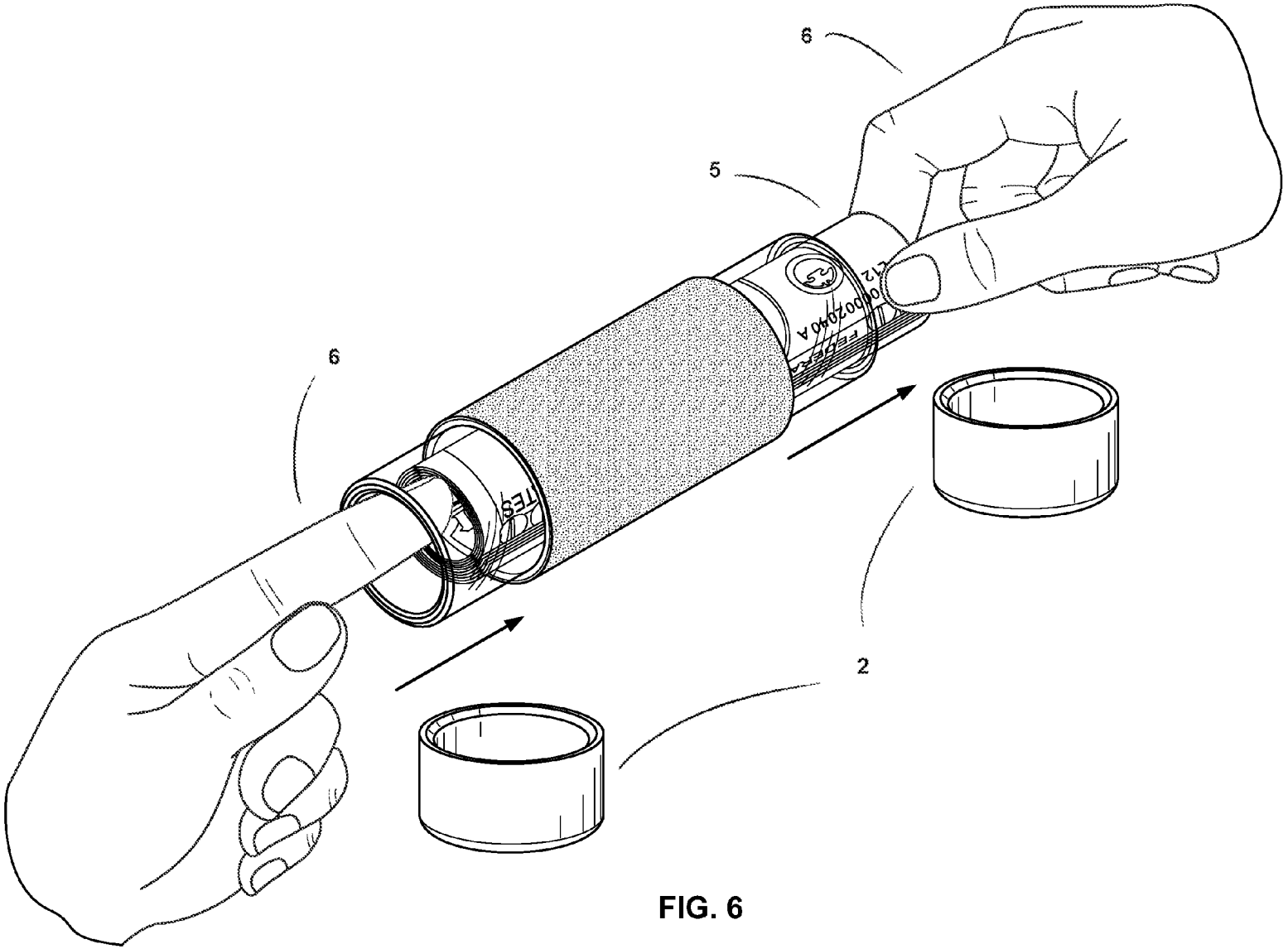
FIG. 6 is a view depicting the removal of a roll of bank notes 5 from the device shown FIG. 1 with both of the end caps 2 removed.

The allowance for two access points, by having both ends open, allows for one to use two hands 6 if need be to easily remove the contents. This would generally be hard to do if one end was closed; applications and uses would therefore be confined to items that fit loosely. One would be presented with great difficultly when attempting to remove a roll of bank notes 5, documents, or other tightly packed objects. FIG. 6 depicts application of this concept.

Figure 4:
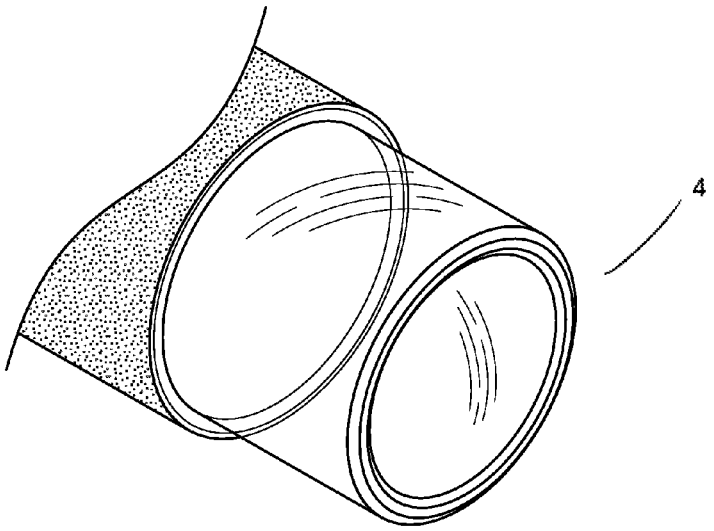
FIG. 4 is a close up view of one of the open ends of the device shown in FIG. 1, depicting the chamfered inner and outer edges 4.
Figure 5:
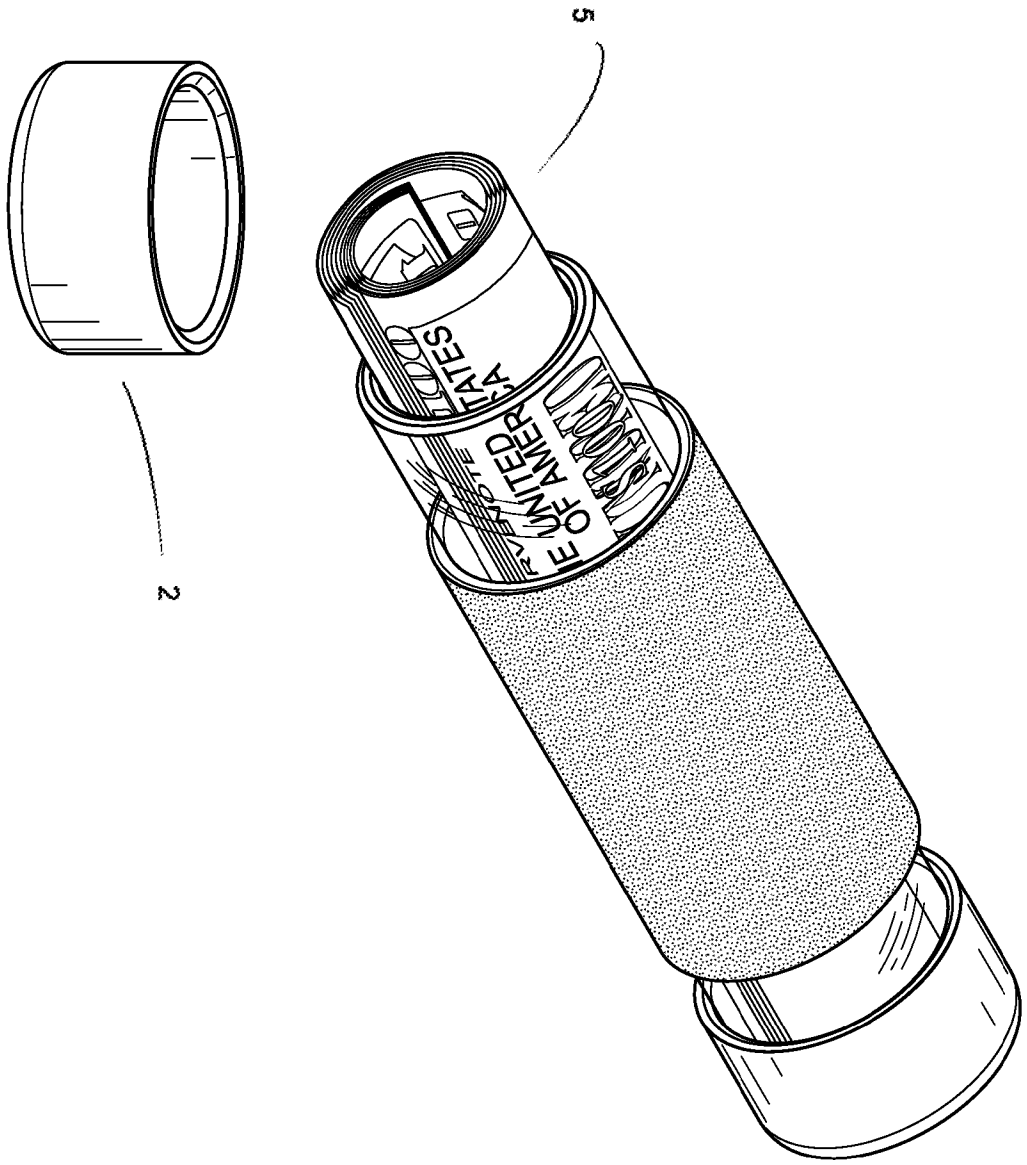
FIG. 5 is a perspective view of the device shown in FIG. 1 depicting an example of a possible application protecting a roll of currency 5 within, shown with an end cap 2 removed.

Beyond the amount needed to remove the burs incurred during previous manufacturing steps, the inner and outer edges 4 are tapered to facilitate the placement of the end caps 2 and provide for a smoother interaction between the user's fingers and the device. The open ends of the cut lengths are machined, removing the corners between each of cut ends and both the inner and outer walls. A total of four edges are chamfered in the case of the cylindrical model. The end caps 2 also employ a tapered edge to further reduce the effort required during placement. A closer view depicting the chamfered edges 4 of the open end of the device is shown in FIG. 4.

Figure 3:
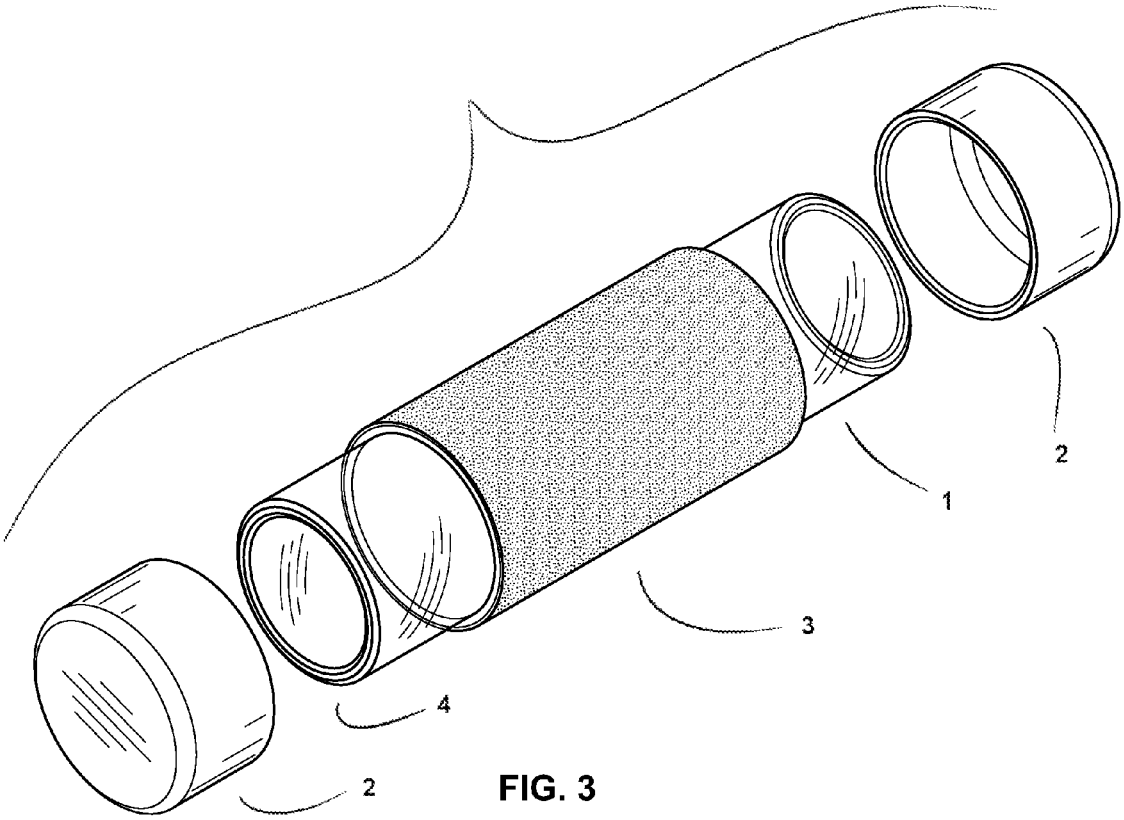
FIG. 3 is an exploded view of the device shown in FIG. 1.

The disclosed example utilizes a selectively attachable material. In this disclosed example a hook and loop type fastener, commonly known as Velcro, is utilized as the selectively attachable material, although other selectively attachable material as is known could also be utilized. In this example, loop type Velcro 3 is cut to length according to the dimensions required to encompass 360 degrees around the outside of the tube 1; the length of the cut strip covering one hundred percent of the longitudinal surface. The cut Velcro strip is centered and wrapped around the equatorial surface of the previously worked tube. By means of adhesive, the Velcro strip is permanently affixed and the elements making up 1, 3, and 4 as shown in FIG. 3 can be viewed as a single component. The permanently attached Velcro 3 further attests to the solid and sound structural nature of the device, dissimilar to a selectively attachable sleeve or strap that could fall off or stretch with time. Furthermore, with the loop Velcro 3 being permanently affixed 360 degrees around the device; it is able to offer the benefits of completely blind placement. This is a very desirable quality and often a necessity, when using the device in hidden and concealed places; where oftentimes space is limited and the view obstructed. Devices of a similarly selectively attachable nature generally must be strategically aligned prior to attaching them to their base units. While this may be suitable for using these devices as their respective inventors originally intended in plain sight; it severely hinders the operation in a concealed environment.

Choice of a loop type fastener on the outer surface of the device prevents it from gathering debris or sticking to other items while in the purse or pockets. Additionally, the current device places emphasis on comfort in the hand by employing soft and pleasing materials. Use of the hook type Velcro attracts all kinds of hair, dirt and other debris and is therefore found less than desirable. This device would continue to function as intended if the selectively attachable materials were reversed and Velcro of the hook type was used; however, it would fail with respect to being smooth, soft, and pleasing to the touch. Thereby causing a lack in desirability and a lessening of the likelihood of it being selected to carry out a particular use, such as in the pocket or purse; where it may come in contact with lint, loose threads, and other unwanted matter, possible becoming unwantedly attached and hindering the removal from the pocket or purse.

Things that are soft and pleasing to the touch and eyes often produce therapeutic results when compared to things that rough and unwelcome to the touch and eyes. This can be seen in items such as stress balls, silly putty, and slime from a quarter operated gumball machine, where the sole intent is to be pleasing to the touch. This is obviously not the common thought process of those skilled in arts relating to the use of Velcro as a selectively attachable material. Others specify the hook surface to be the preferred material involving contact with the hand in relation to their inventions. Loop type Velcro 3 was found to be a far more suitable material for the types of environments in which the current device is used and therefore the loop type fastener is employed as the material of choice for use as the contact point for handling of the device as well as that with the largest surface area, which also serves the purpose of providing greater success when attaching the device blindly.

Though seemingly simple in design and construction, the principles at work behind the selection of materials are in depth. The end caps 2 are made from a flexible material with a high coefficient of friction. The device is able to be opened from one or both ends, allowing contents to be pushed out if need be, thereby preventing items from getting trapped in the container.

The device and the environment within it are secured through the use of end caps 2 of the corresponding size. This device is not claiming rocket science by any means, yet the science at work in the device is not of insignificance. There are noted differences among different materials, and consequentially different results are obtained with variation of choice. Not all closures produce the same effects. More specifically not all caps of a similar shape and size would serve the purpose of the present device and consequentially, unless by means of chance or luck, would not be selected by someone unfamiliar with the material properties of the components outlined in the description.

The flexible end caps 2 employed in the current device achieve their desired effect by applying the principles outlined in Boyle's law. This effect is such that the selectively attachable caps are secured by means in addition to the interference fit created by the selection of the size of the components.

The caps on the device are also secured by means of negative air pressure. When the flexible end caps 2 are placed on, and the centers depressed with the finger tips, a portion of the air within the cylinder is displaced. When the fingers are taken away from the caps and external pressure removed, the nature of the flexible caps is that of wanting to return to their original shape. As a result of the caps' innate desire to return to their original shape there is a slight increase in volume within the device; given a constant temperature, a small vacuum is then essentially created within. This vacuum combined with the friction of the interference fit, effectively creates a sealed environment, further protecting and preserving the contents of the container. Through use of the sealed environment contamination is prevented and the effects of oxidation are significantly reduced. The slight vacuum preserves the contents by creating an environment inhospitable for bacteria and reduces further degradation of the contents.

This above concept of two different sealing methods to secure the caps is more apparently demonstrated with the larger diameter tubes, where a larger volume of air is displaced. In this case, one can see when the sealing action accomplished by the interference fit is overcome by the pressure differential created by the change in volume during the placement of the end caps 2 upon the ends. If additional pressure is not supplied by the user to the external surface of an already in place cap, frictional forces will be overcome and the cap will be ejected from the end of the tube. This principle works in similar manner, combined with the interference fit, to keep the end caps 2 in place and maintain the sealed environment within.

Given that the device is used at a fairly consistent temperature, the unintentional removal of the caps would cause an increase in volume within the device; this increase in volume consequentially causes a decrease in pressure within, effectively resisting the unintentional removal of the caps. When removal of the caps is desired, the seal is slightly displaced such that a small amount air is able to be drawn back into the container, thereby equalizing the pressure differential and allowing the caps to be easily removed as intended.

Figure 1:
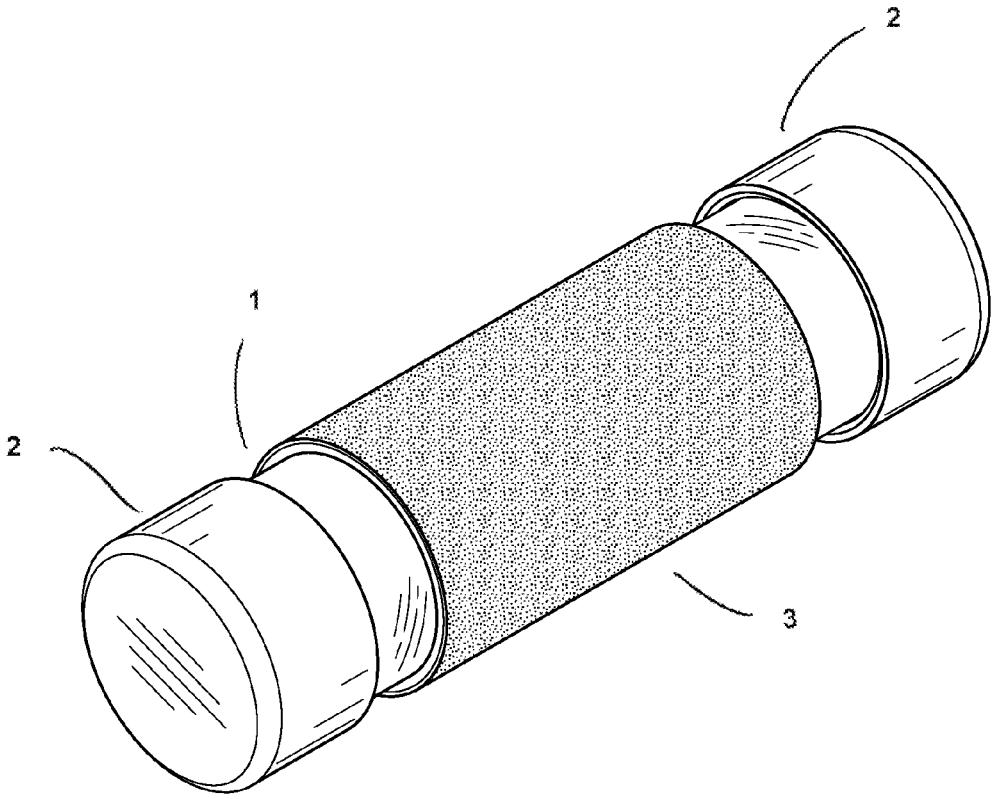
FIG. 1 is a perspective view of the device as described herein.
Figure 2:
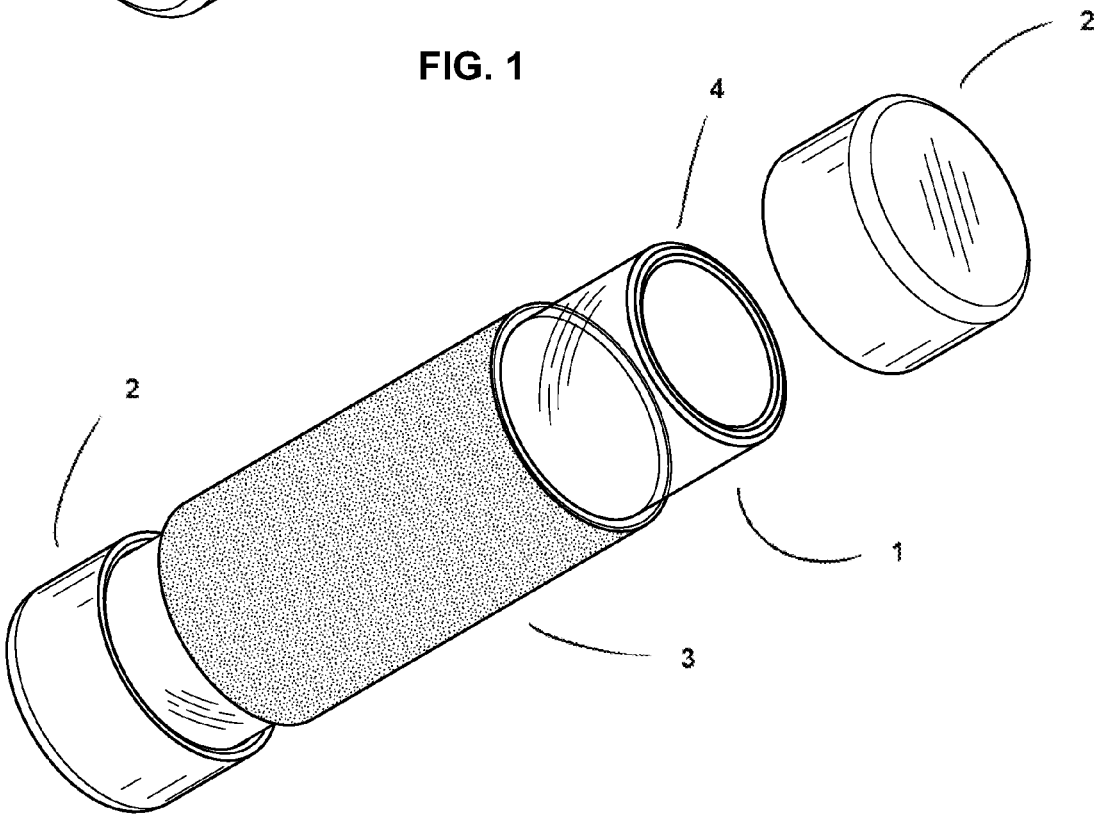
FIG. 2 is a perspective view of the device shown in FIG. 1 with an end cap 2 removed.

The device is used by removing one of the end caps 2 as shown in FIG. 2. The user can then place the desired contents within the device. After which the end cap 2 can be replaced and secured in the manner described above by using one's fingers to simultaneously depress the centers of both end caps 2. The smaller model of the device can then be conveniently carried in a pant or shirt pocket. For further security, the user can affix a section of the self-adhesive hook type Velcro 9 to an unobservable surface. The device can now be selectively attached to this out of sight surface, thereby allowing the device and its contents to be safely secured in a hidden location.

Both caps 2 of the device are able to be removed to facilitate removal of the contents of the device as in FIG. 6; shown with a roll of money 5 within, being pushed out one side, with a finger 6 applying pressure to the opposite side. This is beneficial in a situation where the contents of the device may be tightly packed and therefore difficult to remove using the effects of gravity alone. A situation which would be equally difficult if there were only one opening, in which case there would likely be insufficient space at the opening, inhibiting the thumb and fingers from using a pinching action to remove the contents.

Similar devices involving containers and Velcro as a selectively attachable medium require complex, and consequentially more expensive, base mounting apparatuses to which the containers are selectively attached. The current system involves the use of a simple section of commonly available hook type Velcro 9, which may be cut to size by the consumer using household scissors and then permanently affixed to a selected location; nearly anywhere of the user's choosing, by means of simply removing the backing of the self-adhesive Velcro strip. This is provided to the customer at a significantly reduced price when compared to the complex base units of other devices, allowing the savings to be able to be passed directly on to the customer. Many of the other devices would fail to function in the spirit of their respective inventor's original intent with this simpler solution.

The device can be hidden in any number of locations, such as: underneath the seat or the dash of an automobile, under a desk, the bottom side of a chair, or behind a bookshelf. When utilized in a concealed location, the device can be used to store any number of items, such as: emergency money, a list of phone numbers in the event of a lost phone or dead battery, keys, important documents, passwords, and digital storage media.

Figure 7:
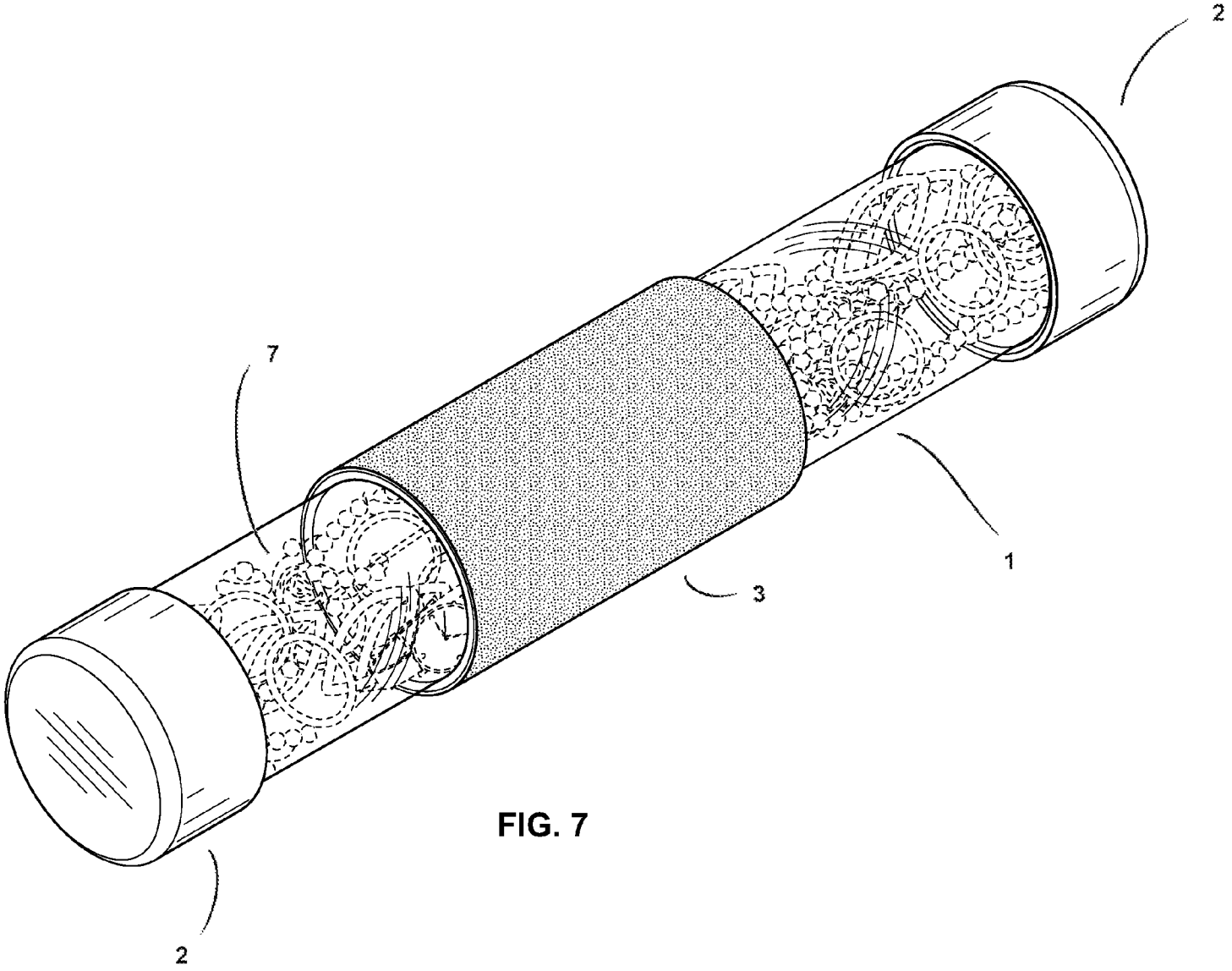
FIG. 7 is a perspective view depicting a possible variation of design as described herein, showing larger dimensions and a possible application protecting jewelry and other items of value 7 within.

Possible uses include storing the likes of grandma's antique irreplaceable diamond ring, a flash drive or other fragile objects that would become damaged if crushed. FIG. 7 depicts a larger model of the device utilized for the protection of watches, jewelry and other items of value 7.

Use could also be found as a container for the storage of registration papers on a jet ski, boat, or other watercraft where moisture may render the documents unreadable and therefore unacceptable to law enforcement.

Instructions supplied with the device are designed to stimulate, inspire, and teach the reader; assisting them in selecting a preferred location in which to conceal the device. These instructions are particularly helpful for assisting in concealment of the device in unobvious locations. As the potential applications are vast and specific locations of use may vary, the instructions are designed to be suggestive and to encourage creativity and the use of imagination when selecting a location. The user is directed to a line of thinking different from that which they may be accustomed to. Additionally, examples of suggested use and possible locations are given that may be commonly found in the average household or automobile.

These instructions direct the user toward possible locations that are generally out of the line of sight, such that without actively searching for the specific object, the locations are not likely to be seen. The instructions suggest that most often these are locations where one can fit their hand, but not their head. The user is instructed to select a location out of sight and not to mention the location to others. Regarding usage of the device in an automobile, they are directed that the best location is likely up under the dash or in the trunk. It is suggested to grab a bright light and explore with their hands; to seek out a spot behind something. That an obstructed view would work best, so that if one stuck their head down there, they wouldn't be able to see it.

Figure 9:
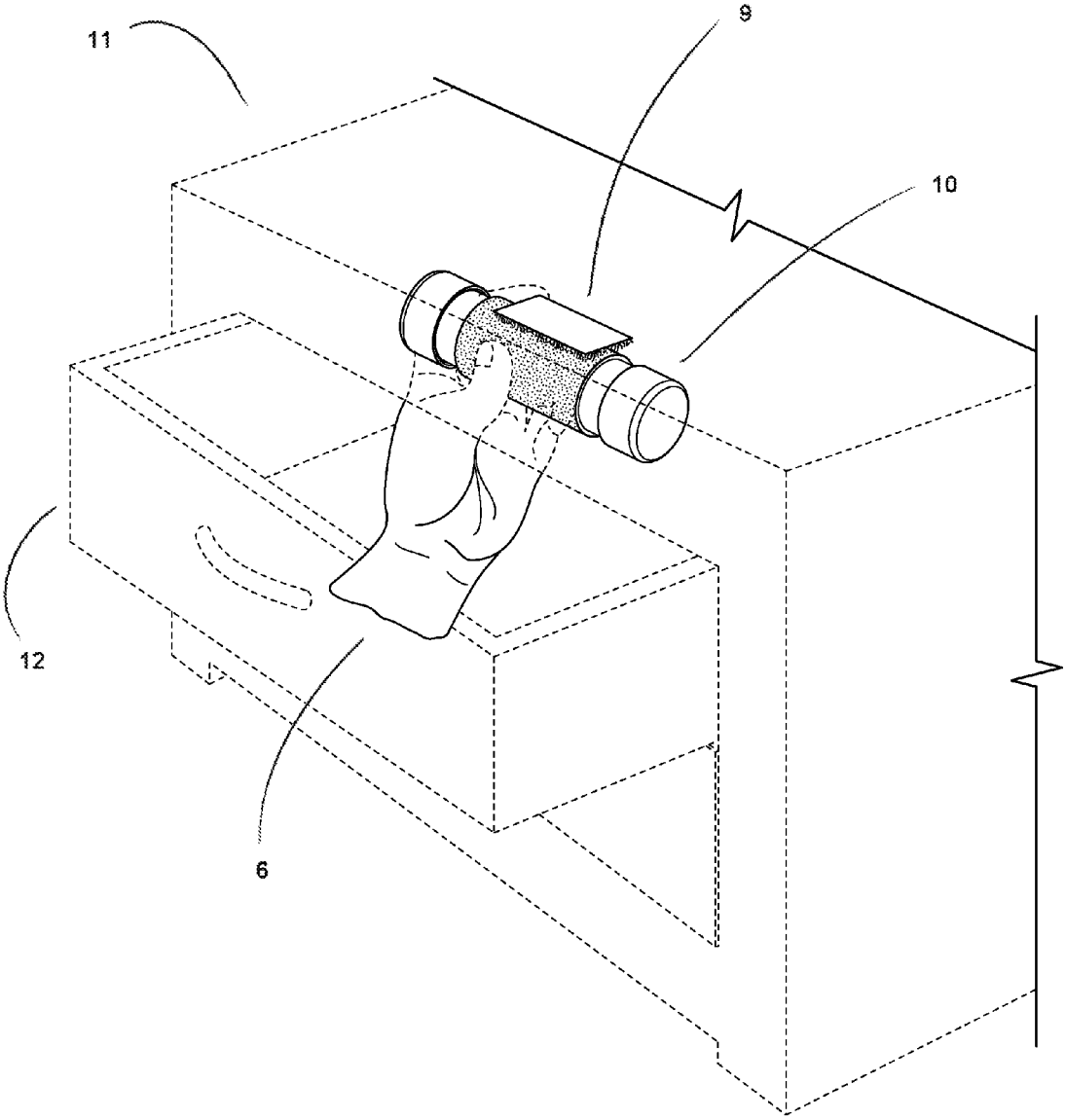
FIG. 9 is a view of the device shown in FIG. 1 depicting a possible concealed usage location as suggested in the provided instruction.

As for in the house, it's pretty much the same concept; out of sight, out of mind. The user is directed to look with their hands, put them places they can't see. They are instructed that the self-adhesive Velcro sticks 9 just about anywhere and can be cut to size, so that if it fits, it will likely work. They are directed to pull out the top drawer 12 of something, to put their hand up there and feel for the bottom side of the top of the dresser, counter, or whatever else. FIG. 9 depicts a possible application demonstrating the concealability of the device 10 when used with a drawer unit 11 as suggested by the instructions. It is also suggested that the bottom side of the lower shelf on a bookcase would likely also be a good location.

It is proposed that an intruder is not likely to remove every single kitchen drawer and bend down to carefully inspect each and every resulting empty space. So that even when the drawer is fully removed and emptied, the device remains securely hidden in place; thus leaving the prospective intruder to move on to the next location. The device serves a similar purpose throughout the house and in automobiles as well. The user is reminded that usage of the device should not be confined to that suggested and they are encouraged to keep an open mind when selecting a location.

During manufacture, the size and shape of the device can be adjusted to suit the contents of a desired application. The device can potentially be made in any closed walled shape, such as circular, triangular, or square. The device also can potentially be made to any size, realizing that concealability decreases as size increases; though the protective nature the first type remains.

Figure 8:
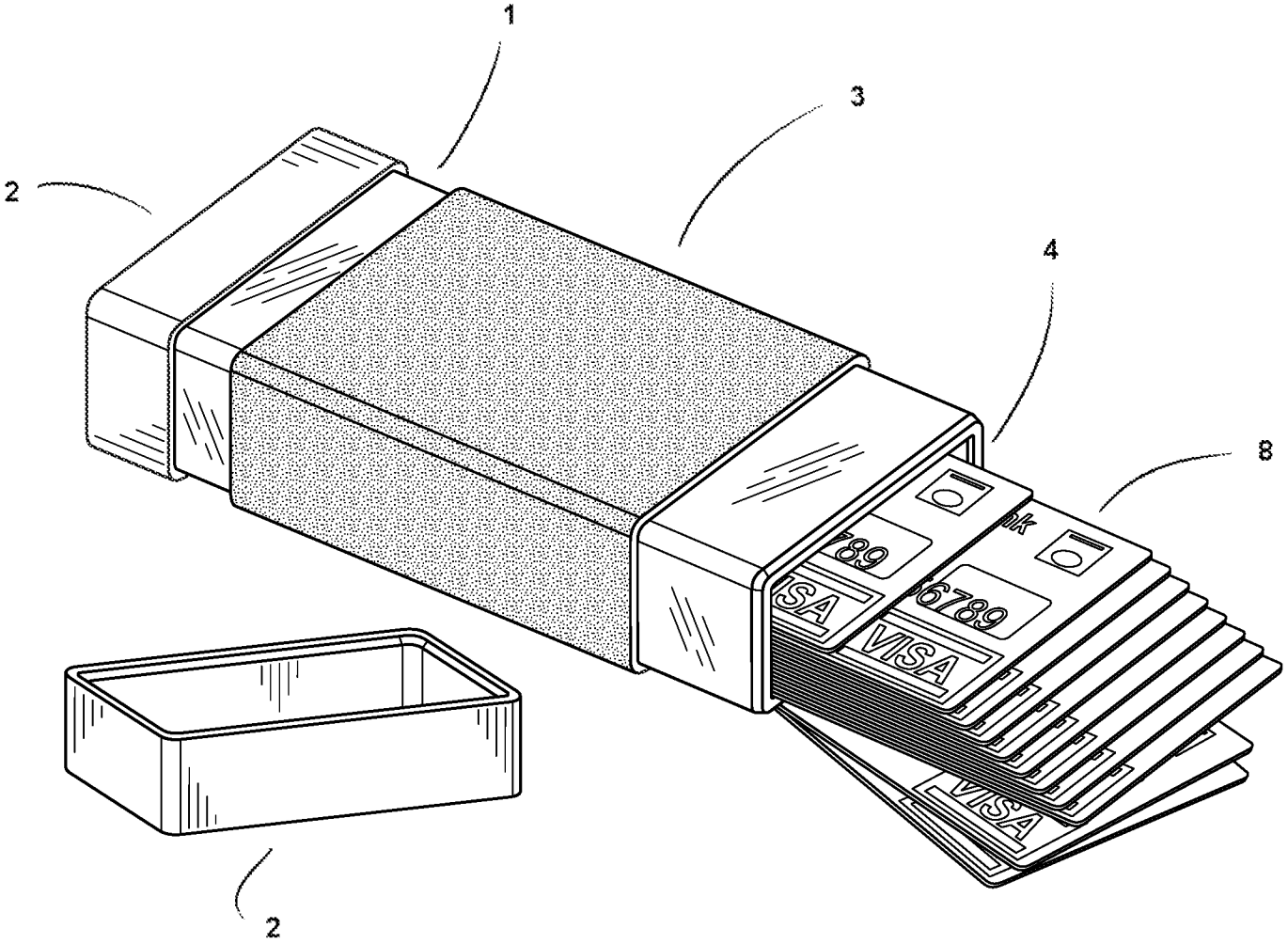
FIG. 8 is a perspective view depicting a possible variation of design as described herein, showing a rectangular model and a possible application protecting credit and check cards 8 within, shown with an end cap 2 removed.

FIG. 8 depicts a view of the design with adjustments made to geometry and dimensions with the intentions of providing protective storage for spare credit cards 8. This particular embodiment enables the user to secure and protect spare or extra credit cards 8 from unauthorized access; cards that may otherwise be left vulnerable sitting in a desk or dresser drawer.

Sections of the clear tubing 1 can be left exposed, permitting the contents to be viewed. The device can also be made opaque, requiring it to be opened in order to view the contents. The device can also be made available in different colors, thereby allowing for the user to express personal taste, or for quick identification of the contents.

The materials used to construct the device can be altered to suit the application; currently, it has been found that polycarbonate provides superior crush resistance, while the vinyl caps provide a convenient closure and secure seal.

The primary function of this device is that of a protective storage device. This device is able to be tailored to suit the user's need. With adjustments to dimensions, geometry, colors, and intentions; this invention can be made to accommodate a vast range of items, and to serve any number of applications. The scope of potential applications is vast, limited only by the user's imagination. It's not the individual components, but the careful selection and combination thereof that make this device unique and desirable. The above embodiments and description herein describe that which have already served useful and should in no way be limiting as to its future usage except as outlined in the claims which follow.

The invention claimed is:

1. A portable, protective storage device comprising:

a closed-walled shape extruded lengthwise with the length of the center being hollow and both ends being open, essentially forming a tube, constructed of a material resistant to deformation when subjected to an applied force in any direction, wherein the ends of the tube include edges that are chamfered to provide rounded corners for easier placement of end caps;

a material of a selectively attachable nature wrapped 360 degrees around the tube midway between the ends, the material being permanently affixed by an adhesive such that an outer surface of the tube is made selectively attachable from any direction when the tube is rotated about a longitudinal axis; and selectively attachable end caps made of a flexible material with a high coefficient of friction securable to the outer surface at the ends of the tube providing a sealed environment within the tube.

2. The device as recited in claim 1, wherein the material of the tube comprises polycarbonate, the material of a selectively attachable nature being loop type fabric, and the material of the selectively attachable end caps comprises vinyl.

3. The device as recited in claim 1, wherein the tube comprises a wherein the tube comprises a rigid polycarbonate material that retains the desired closed shape against an applied force.

4. The device as recited in claim 1, wherein the material of a selectively attachable nature comprise a first part comprising a hook type material and a second part of a loop type material, wherein one of the first part and the second part is attached to the tube.

* * * * *